US006906668B2

(12) United States Patent
Rawnick et al.

(10) Patent No.: US 6,906,668 B2
(45) Date of Patent: Jun. 14, 2005

(54) DYNAMICALLY RECONFIGURABLE APERTURE COUPLED ANTENNA

(75) Inventors: James J. Rawnick, Palm Bay, FL (US); Stephen B. Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/458,859

(22) Filed: Jun. 11, 2003

(65) Prior Publication Data

US 2004/0252058 A1 Dec. 16, 2004

(51) Int. Cl.[7] ..... H01Q 1/38
(52) U.S. Cl. ..... 343/700 MS; 343/767
(58) Field of Search ..... 343/700 MS, 767, 343/829, 846

(56) References Cited

U.S. PATENT DOCUMENTS

| | | | | |
|---|---|---|---|---|
| 3,971,878 A | * | 7/1976 | Huang et al. | 174/30 |
| 5,162,972 A | | 11/1992 | Gripshover et al. | |
| 6,097,271 A | * | 8/2000 | Kozakoff | 333/204 |
| 6,388,317 B1 | * | 5/2002 | Reese | 257/713 |
| 6,515,235 B2 | | 2/2003 | Moller | |
| 6,590,544 B1 | * | 7/2003 | Filipovic | 343/753 |
| 6,642,902 B2 | * | 11/2003 | Gustafson | 343/791 |

OTHER PUBLICATIONS

U.S. Appl. No. 10/626,090, Brown et al., filed Jul. 24, 2003.
U.S. Appl. No. 10/635,582, Rawnick et al., filed Aug. 6, 2003.
U.S. Appl. No. 10/632,632, Rawnick et al., filed Aug. 1, 2003.
U.S. Appl. No. 10/614,149, Brown et al., filed Jul. 7, 2003.
U.S. Appl. No. 10/634,219, Rawnick et al., filed Aug. 5, 2003.
U.S. Appl. No. 10/624,378, Brown et al., filed Jul. 22, 2003.
U.S. Appl. No. 10/438,433, Rawnick et al., filed May 15, 2003.
U.S. Appl. No. 10/460,947, Rawnick et al., filed Jun. 13, 2003.
U.S. Appl. No. 10/421,352, Rawnick et al., filed Apr. 23, 2003.
U.S. Appl. No. 10/409,261, Pike, filed Apr. 8, 2003.
U.S. Appl. No. 10/441,743, Pike, filed May 19, 2003.
U.S. Appl. No. 10/628,846, Pike et al., filed Jul. 28, 2003.
U.S. Appl. No. 10/448,973, Delgado et al., filed May 30, 2003.
U.S. Appl. No. 10/300,455, Brown et al., filed Nov. 19, 2002.
U.S. Appl. No. 10/369,436, Rawnick et al., filed Feb. 18, 2003.
U.S. Appl. No. 10/387,208, Rawnick et al., filed Mar. 11, 2003.
U.S. Appl. No. 10/330,755, Rawnick et al., filed Dec. 27, 2002.
U.S. Appl. No. 10/330,754, Rawnick et al., filed Dec. 27, 2002.

(Continued)

*Primary Examiner*—Tho Phan
(74) *Attorney, Agent, or Firm*—Sacco & Associates, PA

(57) ABSTRACT

Method for controlling an input impedance of an antenna (100). The method can include the steps of coupling RF energy from an input RF transmission line (106) to an antenna radiating element (102) through an aperture (112) defined in a ground plane (110). For example, the aperture (112) can be a slot and the radiating element (102) can be a patch type element. The input impedance can thereafter be controlled by selectively varying a volume of a fluid dielectric (128) disposed in a predetermined region between the RF transmission line and the antenna radiating element. The volume of fluid dielectric (128) can be automatically varied in response to at least one control signal (121), which can include a feedback signal provided by a sensor (132).

19 Claims, 3 Drawing Sheets

OTHER PUBLICATIONS

U.S. Appl. No. 10/300,456, Rawnick et al., filed Nov. 19, 2002.
U.S. Appl. No. 10/361,548, Rawnick et al., filed Feb. 10, 2003.
U.S. Appl. No. 10/387,209, Rawnick et al., filed Mar. 11, 2003.
U.S. Appl. No. 10/439,094, Rawnick et al., filed May 15, 2003.
U.S. Appl. No. 10/387,194, Brown et al., filed Mar. 11, 2003.
U.S. Appl. No. 10/438,435, Brown et al., filed May 15, 2003.
U.S. Appl. No. 10/414,696, Brown et al., filed Apr. 16, 2003.
U.S. Appl. No. 10/637,027, Brown et al., filed Aug. 7, 2003.
U.S. Appl. No. 10/414,650, Brown et al., filed Apr. 16, 2003.
U.S. Appl. No. 10/635,629, Brown et al., filed Aug. 6, 2003.
U.S. Appl. No. 10/459,067, Brown et al., filed Jun. 11, 2003.
U.S. Appl. No. 10/438,436, Rawnick et al., filed May 15, 2003.

* cited by examiner

DYNAMICALLY RECONFIGURABLE APERTURE COUPLED ANTENNA

BACKGROUND OF THE INVENTION

1. Statement of the Technical Field

The invention concerns antennas and more particularly aperture coupled antennas that can be dynamically modified to operate over a relatively large bandwidth.

2. Description of the Related Art

Patch antennas are well known in the art and are used in a wide variety of applications. They can be manufactured in a nearly unlimited number of shapes and sizes, and can be made to conform to most surface profiles. Patch antennas also possess an omni-directional radiation pattern that is desirable for many uses.

One negative aspect of patch antennas is that they usually have a relatively narrow impedance bandwidth. For a typical classically fed patch antenna, bandwidth is usually about 2% to 3%. Patch antennas that are fed with an aperture or slot can have slightly higher bandwidths, in the range from about 4% to 6%, but this is still too narrow for many applications. The impedance of a patch antenna is also noteworthy as it can depart significantly from 50Ω. Consequently, most patch antennas need a matching network in order to ensure efficient power transfer, particularly if when fed with coaxial cables that can be lossy at high levels of VSWR.

Impedance matching for a patch antenna can be accomplished using several different approaches. For example, a quarter wave high impedance transmission line transformer can be used for this purpose. Alternatively since the impedance is at a minimum at the center of the patch and increases along the axis, a 50Ω microstrip line can be extended into the interior of the patch to achieve a suitable match. In yet another alternative, a center conductor of a coaxial line can be routed through a dielectric substrate on which the conductive patch is disposed to contact the underside of the patch at a selected impedance point.

Still, the performance of most conventional matching systems will be frequency dependent. Accordingly, the input impedance of the antenna system will tend to vary considerably over a relatively large bandwidth. Consequently, the usable bandwidth of the conventional patch antenna will remain relatively limited.

SUMMARY OF THE INVENTION

The invention concerns a method for controlling an input impedance of an antenna. The method can include the steps of coupling RF energy from an input RF transmission line to an antenna radiating element through an aperture defined in a ground plane. For example, the aperture can be a slot and the radiating element can be a conductive metal patch type element. The input impedance can be controlled by selectively varying one of both of a volume and a position of a fluid dielectric disposed in a predetermined region between the RF transmission line and the antenna radiating element. The volume and/or position of the fluid dielectric can be automatically varied in response to at least one control signal, which can include a feedback signal provided by a sensor. The fluid dielectric can be constrained in a dielectric cavity structure that can be formed in a substrate on which the RF transmission line or antenna radiating element is disposed.

According to one aspect of the invention the volume and/or the position of fluid dielectric can be controlled so as to maintain a relatively constant input impedance over a selected range of frequencies. As used herein, this should be understood to mean that the input impedance is maintained within a predetermined range of values that will ensure relatively low input VSWR over the range of frequencies, it being understood that slight variations in input impedance can occur. The permittivity and permeability of the fluid dielectric can be selected to produce a pre-determined value of input impedance, e.g. 50 ohms, over the selected range of frequencies.

According to another aspect, the invention can include an aperture coupled antenna comprised of an input RF transmission line, a antenna radiating element, and an aperture defined in a ground plane through which RF energy from the RF transmission line is coupled to the antenna radiating element. For example, the aperture can be a slot and the radiating element can be a conductive metal patch type element. A fluid control system can be provided for selectively varying the volume and/or position of a fluid dielectric disposed in a predetermined region between the RF transmission line and the antenna radiating element for controlling an input impedance of the antenna. The fluid dielectric can be constrained in a dielectric cavity structure which can, for example, be disposed between the aperture and the RF transmission line. the fluid control system further can comprise a controller, for automatically varying the volume and/or position in response to a control signal, and at least one or more of a valve, a pump and a fluid reservoir.

According to one aspect of the invention, the controller can vary at least one of the fluid volume and position to maintain a relatively constant input impedance over a selected range of frequencies. Also, the fluid dielectric is preferably selected to have a permeability for produce a pre-determined value of the input impedance over a selected range of frequencies. For example, the input impedance can be maintained at 50 ohms.

DETAILED DESCRIPTION OF THE PREFERRED EMBODIMENTS

Figure 1:
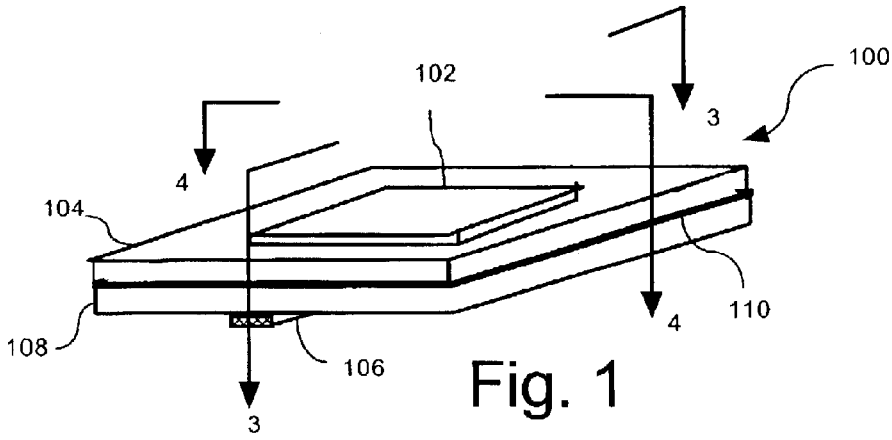
FIG. 1 is a perspective view of a patch antenna that is useful for understanding the present invention.

FIG. 1 is a perspective view of an aperture-fed patch antenna 100 that is useful for understanding the invention. The antenna is-comprised of a radiating element 102 disposed on a dielectric antenna substrate 104. The radiating element 102 in FIG. 1 is shown as having a square geometry as is common for patch type antennas, but it should be understood that the invention is not so limited. Instead, the radiating element 102 can have any of a wide variety of geometric designs as would be known to those skilled in the art.

A feed line 106 can be disposed on a surface of the antenna 100 opposed from the radiating element 102. According to a preferred embodiment, the feed line 106 can be a microstrip transmission line as shown. However, the invention is not limited in this regard and other arrangements are also possible. For example, feed line 106 could also be arranged in a buried microstrip or stripline configuration.

Figure 2:
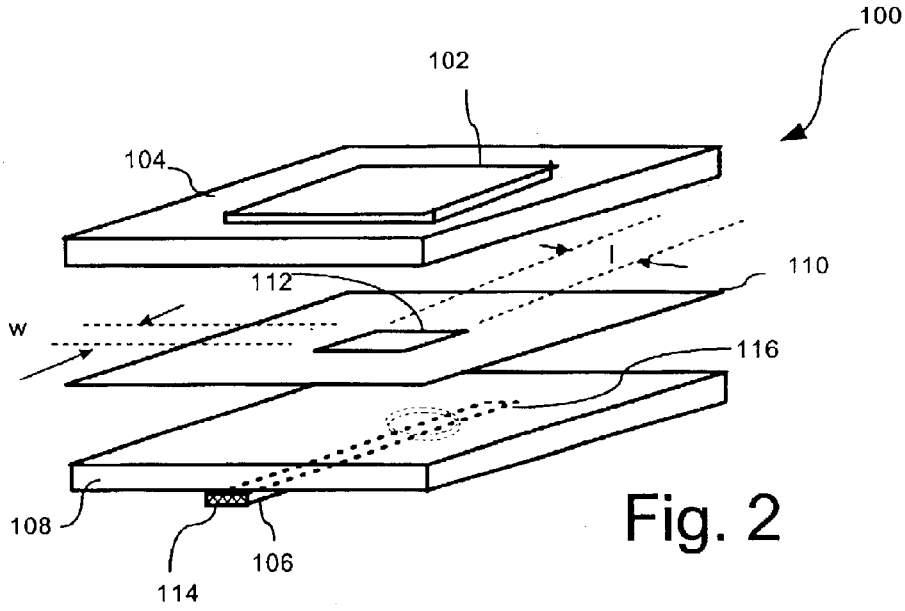
FIG. 2 is an exploded view of the patch antenna of FIG. 1.

As illustrated in FIGS. 1 and 2, the feed line 106 can be disposed on a dielectric feed substrate 108. The antenna substrate 104 can be separated from the feed substrate 108 by a conductive metal ground plane 110. The antenna substrate and the feed substrate can be formed from any of a number of commercially available forms of dielectric materials. For example, low and high temperature cofired ceramics (LTCC, HTCC) can be used for this purpose. An example of an LTCC would include low temperature 951 cofire Green TapeTM from Dupont®. This material is Au and Ag compatible and has acceptable mechanical properties. It is available in thicknesses ranging from 114 $\mu$m to 254 $\mu$m and is designed for use as an insulating layer in hybrid circuits, multichip modules, single chip packages, and ceramic printed wire boards, including RF circuit boards. Alternatively, the dielectric substrates can be formed from other materials commonly used as RF substrates, including Teflon® PTFE (PolyTetraFluoroEthylene) composites of glass fiber, woven glass and ceramics. Such products are commercially available from a variety of manufacturers. For example, Rogers Corporation of Chandler, Arizona offers such products under the trade name RT/duroid including product numbers 5880, 6002, and 6010LM. Unlike LTCC materials, these types of substrates do not generally require a firing step before they can be used.

Aperture 112 is preferably provided in the ground plane 110 for coupling RF energy from the feed line 106 to the radiating element 102. The aperture 112 is preferably a slot and can be approximately centered beneath the radiating element 102 in accordance with conventional aperture-fed patch antenna designs. However, other shapes and positions for the aperture 112 can also be acceptable. Further, the feed line 106 preferably traverses the area defined by the aperture 112 on a side of the feed substrate opposed from the ground plane 110 and can include a stub that terminates somewhat beyond the point of intersection as shown.

With the arrangement of the antenna 100 as described herein, RF energy communicated to the feed line 106 at feed port 114 can be effectively coupled to the radiating element 102. In conventional aperture fed antenna systems, it is well known that there are several parameters that can be varied in order to control the input impedance of the antenna 100 as seen, for example, at feed port 114. These parameters include the dimensions of the aperture 112, the width of feed line 106, the position of the aperture 112 relative to the radiating element 102 and the length of the feed line stub 116 extending past the aperture. Most commonly, the aperture length (transverse to the feed line 106) and the length of stub 116 are selected to control the input impedance observed at an antenna feed port 114. The length of the aperture 112 determines the coupling level between the feed line 106 and the radiating element 102 and therefore can be used to vary the input impedance observed at antenna feed port 114. Changing the length of the stub can compensate for the inductance of the aperture so as to create a real impedance for the radiating element.

One problem with impedance matching using the foregoing approaches is that they are static systems and cannot be varied once the design is selected. The present invention provides an approach by which dynamic control over the input impedance can be achieved using fluids to vary the coupling between the feed line 106 and the radiating element 102.

According to one embodiment of the invention, coupling between the feed line 106 and the radiating element 102 can be controlled by selectively varying one or both of a volume and a position of dielectric fluid 128 in a region of the substrate near the aperture 112. By choosing appropriate values of permittivity and permeability, variations in the volume and/or position of the fluid dielectric 128 communicated to this region can effectively vary the coupling between the feed line 106 and the radiating element 102. In so doing, the input impedance of the antenna can be selectively controlled. For example, the matching system can change either or both of the volume and the position of fluid dielectric to dynamically compensate for impedance variations caused by changes in frequency. The changes in fluid volume can be performed on a continuously variable basis consistent with changes in frequency. Alternatively, the fluid can be varied in discrete steps to create two or more operating predetermined operating configurations that can correspond to particular operating conditions, e.g. two or more specific operational bands. According to one aspect of the invention, the impedance can be maintained at a relatively constant value over a range of frequencies. As used herein, the term "constant" should be generally understood to mean that the input impedance is maintained within a predetermined range of values that will ensure relatively low input VSWR over the range of frequencies, i.e. less than about 2:1. Slight variations in input impedance within this range are to be expected and are acceptable.

Figure 3:
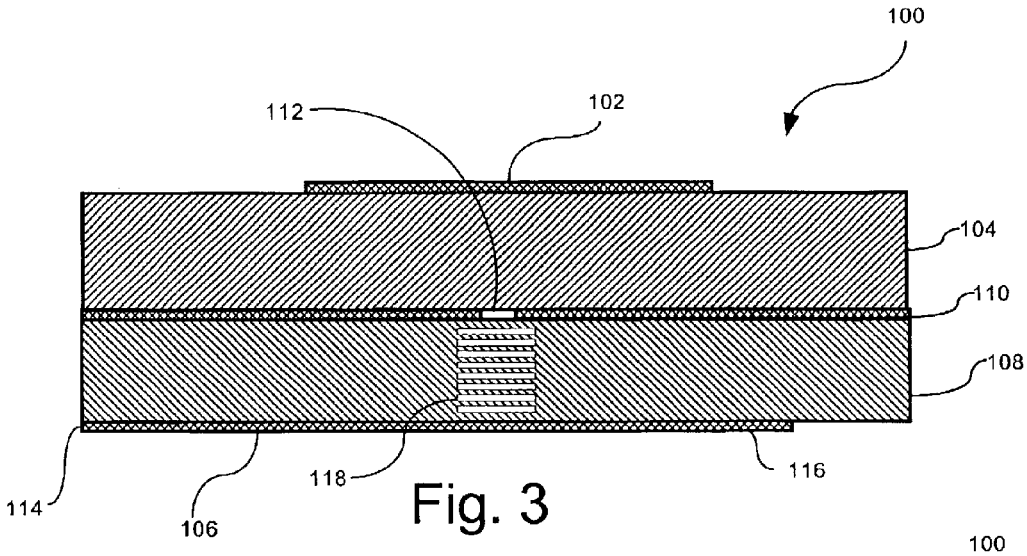
FIG. 3 is an enlarged cross-sectional view of the patch antenna of FIG. 1 taken along line 3-3.
Figure 4:
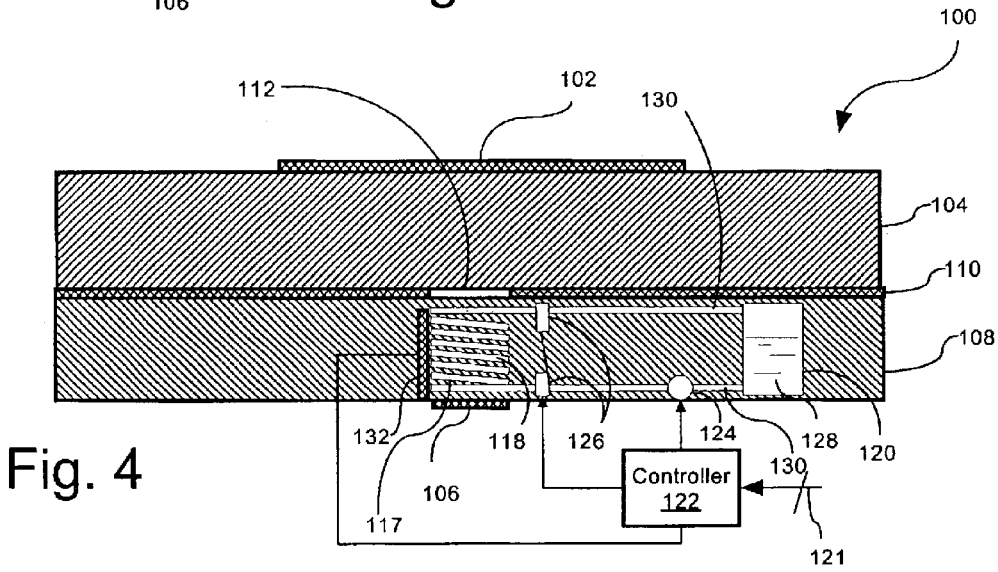
FIG. 4 is an enlarged cross-sectional view of the patch antenna of FIG. 1 taker along line 4-4.

Referring now to FIGS. 3 and 4, the antenna 100 is shown in a cross-sectional view taken along line 3-3 and 4-4, respectively. As illustrated therein, at least a portion of the feed substrate 108 aligned with aperture 112 can include a dielectric cavity structure 117 that defines at least one fluid cavity 118. In FIGS. 3 and 4, the fluid cavity 118 is shown as a helical conduit that traverses at least a portion of the distance between the feed line 106 and the aperture 112. However, the invention is not so limited. The fluid cavity 118 can be any other shape that provides the desired of variation in coupling as between the feed line 106 and the radiating element 102 when the volume of fluid dielectric 128 contained therein is varied in a predetermined way. Notably, varying the volume will also tend to affect the position of the fluid dielectric in this embodiment. In effect, the variation in the volume and position of the fluid dielectric can be used to make the aperture appear electrically smaller or larger. In this regard, it should be noted that while the fluid cavity 118 in FIGS. 3 and 4 is shown only in the area between aperture 112 and feed line 106, the invention is not limited in this regard. Instead, the fluid cavity 118 can extend above and below the aperture 112 and even through the area defined by the aperture 112 for the purpose of controlling the impedance match. Notably, increasing the volume of the fluid dielectric 128 will generally tend to also have some effect on the position of the fluid dielectric in the embodiments described herein.

A fluid control system can be provided to selectively vary at least one of the volume and the position of fluid dielectric 128 contained in fluid cavity 118. The fluid control system can include any combination of fluid reservoirs, conduits, pumps, sensors, valves and controllers as may be appropriate for selectively varying the fluid volume communicated to the fluid cavity 118. For example, as shown in FIG. 4, a quantity of fluid dielectric 128 can be stored in a reservoir 120. The reservoir 120 can be defined within the feed substrate 108 as shown or can be provided externally. Fluid conduits 130, pump 124, sensor 132 and valves 126 can be provided for facilitating the transfer of dielectric fluid 128 to the fluid cavity 118. Those skilled in the art will appreciate that the pumps, valves, and other components of the fluid control system can be conventional type designs or can be formed as micro-electromechanical systems (MEMS) which are also known in the art. A controller 122 can be provided which is responsive to an antenna control signal 123 and information received from sensor 132 for controlling the operation of the pump 124 and valves 126. The controller can be comprised of a microprocessor, a look-up-table, or any other type of electronic control circuit that is responsive to a control signal 121 to perform the required impedance matching.

Composition of the Fluid Dielectric

The fluid dielectric 128 as described herein can be comprised of any fluid composition having the required characteristics of permittivity ($\epsilon r$) and permeability ($\mu r$) as may be necessary for achieving a selected range of impedance matching. For example, those skilled in the art will recognize that one or more component parts can be mixed together to produce a desired permeability and permittivity required for achieving an impedance match for a particular aperture, radiating element and feed line configuration.

The fluid dielectric 128 also preferably has a relatively low loss tangent to minimize the amount of RF energy loss in the coupling. However, devices with higher loss may be acceptable in some instances so this may not be a critical factor. Many applications also require a broadband response. Accordingly, it may be desirable in many instances to select fluid dielectrics that have a relatively constant response over a broad range of frequencies.

Aside from the foregoing constraints, there are relatively few limits on the range of materials that can be used to form the fluid dielectric. Accordingly, those skilled in the art will recognize that the examples of suitable fluid dielectrics as shall be disclosed herein are merely by way of example and are not intended to limit in any way the scope of the invention. Also, while component materials can be mixed in order to produce the fluid dielectric as described herein, it should be noted that the invention is not so limited. Instead, the composition of the fluid dielectric could be formed in other ways. All such techniques will be understood to be included within the scope of the invention.

Those skilled in the art will recognize that a nominal value of relative permittivity ($\epsilon r$) for fluids is approximately 2.0. However, the fluid dielectric used herein can include fluids with higher values of permittivity. For example, the fluid dielectric material could be selected to have permittivity values of between 2.0 and about 58, depending upon the range of impedance matching required required.

Similarly, the fluid dielectric can have a wide range of permeability values. High levels of magnetic permeability are commonly observed in magnetic metals such as Fe and Co. For example, solid alloys of these materials can exhibit levels of $\mu r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organometallic compounds, and other derivatives, although Fe and Co particles are most common. The size of the magnetic particles found in such systems is known to vary to some extent. However, particles sizes in the range of 1 nm to 20 $\mu$m are common. The composition of particles can be selected as necessary to achieve the required permeability in the final fluidic dielectric. Magnetic fluid compositions are typically between about 50% to 90% particles by weight. Increasing the number of particles will generally increase the permeability.

More particularly, a hydrocarbon dielectric oil such as Vacuum Pump Oil MSDS-12602 could be used to realize a low permittivity, low permeability fluid, low electrical loss fluid. A low permittivity, high permeability fluid may be realized by mixing same hydrocarbon fluid with magnetic particles such as magnetite manufactured by FerroTec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture. Solvents such as formamide inherently posses a relatively high permittivity.

Similar techniques could be used to produce fluid dielectrics with higher permittivity. For example, fluid permittivity could be increased by adding high permittivity powders such as barium titanate manufactured by Ferro Corporation of Cleveland, Ohio. For broadband applications, the fluids would not have significant resonances over the frequency band of interest.

Antenna Structure, Materials and Fabrication

According to one aspect of the invention, the antenna substrate 104 and the feed substrate 108 can be formed from a ceramic material. For example, the dielectric structure can be formed from a low temperature co-fired ceramic (LTCC). Processing and fabrication of RF circuits on LTCC is well known to those skilled in the art. LTCC is particularly well suited for the present application because of its compatibility and resistance to attack from a wide range of fluids. The material also has superior properties of wetability and absorption as compared to other types of solid dielectric material. These factors, plus LTCC's proven suitability for manufacturing miniaturized RF circuits, make it a preferred choice for use in the present invention.

Antenna Control Process

Figure 5:
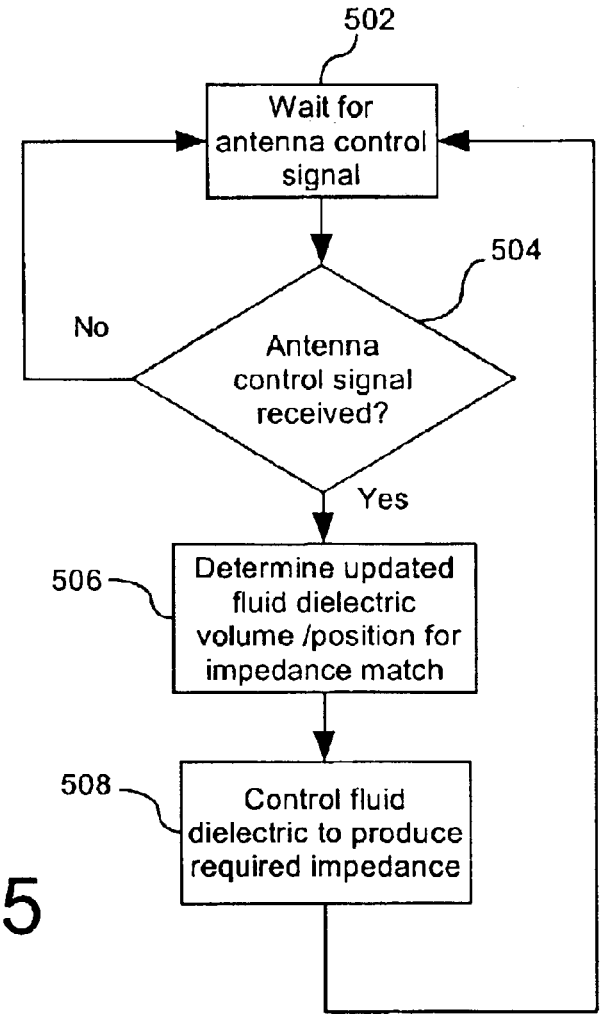
FIG. 5 is a flow chart illustrating a process for controlling an input impedance of the patch antenna.

Referring now to FIG. 5, a process shall be described for controlling the matching system for the patch antenna as disclosed herein. In step 502 and 504, controller 122 can wait for an antenna control signal 121 indicating a required impedance matching condition. This impedance matching condition can indicate a relatively small change in frequency or a switch to a different band of frequencies. Once this information has been received, the controller 122 can determine in step 506 a required amount of fluid dielectric 300 that must be injected into cavity 118 in order to produce the required impedance match. In step 508, the controller 122 can selectively operate the pump 124 and valves 126 respectively associated with antenna 100 to produce the required impedance match.

As an alternative to calculating the required configuration of the fluid dielectric, the controller 122 could also make use of a look-up-table (LUT). The LUT can contain cross-reference information for determining control data antenna 100 necessary to achieve various impedance matches. For example, a calibration process could be used to identify the specific sensor output data communicated to controller 122 necessary to achieve a match at a particular frequency. These digital control signal values could then be stored in the LUT. Thereafter, when control signal 121 is updated, the controller 122 can immediately operate the pump 124 and valve 126 to produce the sensor output data that is required to produce the impedance match indicated by the control signal.

As an alternative, or in addition to the foregoing methods, the controller 122 could make use of an iterative approach that measures an VSWR at an antenna input 114 and then iteratively adjusts the volume of dielectric fluid 128 contained in cavity 118 in order to achieve the lowest possible value. A feedback loop could be employed to control pump 124 and valves 126 to minimize the measured VSWR.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A method for controlling an input impedance of an antenna, comprising the steps of:

coupling RF energy from an input RF transmission line to an antenna radiating element through an aperture defined in a ground plane; and controlling said input impedance by selectively varying at least one of a volume and a position of a fluid dielectric disposed in a predetermined region between said RF transmission line and said antenna radiating element.

2. The method according to claim 1 further comprising the step of maintaining an input impedance of said antenna within a predetermined range over a selected range of frequencies.

3. The method according to claim 1 further comprising the step of selecting a permittivity and a permeability of said fluid dielectric to produce a pre-determined range of values of said input impedance over a selected range of frequencies.

4. The method according to claim 1 further comprising the step of varying at least one of said volume and said position in response to a control signal.

5. The method according to claim 1 further comprising the step of varying at least one of said volume and said position in response to at least one feedback signal provided by a sensor.

6. The method according to claim 1 further comprising the step of forming said aperture as a slot.

7. The method according to claim 1 further comprising the step of selecting said radiating element to be a conductive metal patch.

8. The method according to claim 1 further comprising the step of containing said fluid dielectric in a dielectric cavity structure.

9. An aperture coupled antenna, comprising:

an RF transmission line defining an antenna input;

an antenna radiating element;

an aperture defined in a ground plane through which RF energy from said RF transmission line is coupled to said antenna radiating element;

a fluid control system for selectively varying at least one of a volume and a position of a fluid dielectric disposed in a predetermined region between said RF transmission line and said antenna radiating element for controlling an input impedance of said antenna.

10. The aperture coupled antenna according to claim 9 wherein said fluid control system further comprises a controller for automatically varying at least one of said volume and said input impedance in response to a control signal.

11. The aperture coupled antenna according to claim 9 wherein said fluid control system is comprised of a controller and at least one of a valve, a pump, an a fluid reservoir.

12. The aperture coupled antenna according to claim 10 wherein said controller varies at least one of said volume and said position to maintain a constant input impedance over a selected range of frequencies.

13. The aperture coupled antenna according to claim 9 wherein said fluid dielectric has a permittivity and a permeability selected to produce a pre-determined value of said input impedance over a selected range of frequencies.

14. The aperture coupled antenna according to claim 9 wherein said control system is comprised of a controller and at least one sensor, and said controller varies at least on of said volume and said position in response to at least one feedback signal provided by a sensor.

15. The aperture coupled antenna according to claim 9 wherein said aperture is a slot.

16. The aperture coupled antenna according to claim 9 wherein said radiating element is a conductive metal patch.

17. The aperture coupled antenna according to claim 9 wherein said fluid dielectric is constrained in a dielectric cavity structure.

18. The aperture coupled antenna according to claim 17 wherein said dielectric cavity structure is disposed between said aperture and said RF transmission line.

19. A method for controlling an input impedance of an antenna, comprising the steps of:

configuring an aperture coupled antenna to have a first input impedance at a first operating frequency;

selectively varying at least one of a volume and a position of a fluid dielectric disposed in a predetermined region of said aperture coupled antenna between an input RF transmission line and an antenna radiating element to cause a second input impedance at a second operating frequency to be approximately equal to said first input impedance.

* * * * *